US005577486A

United States Patent [19]

Harima et al.

[11] Patent Number: 5,577,486

[45] Date of Patent: Nov. 26, 1996

[54] FUEL-INJECTION CONTROL APPARATUS FOR AN ENGINE

[75] Inventors: Kenji Harima, Susono; Toshinari Nagai, Shizuoka; Hiroshi Kanai; Akinori Osanai, both of Susono; Kazuhiko Iwano, Aichi; Shuji Yuda, Susono; Takayuki Demura, Mishima, all of Japan

[73] Assignee: Toyota Jidosha Kabushiki Kaisha, Toyota, Japan

[21] Appl. No.: 422,978

[22] Filed: Apr. 17, 1995

[30] Foreign Application Priority Data

Apr. 19, 1994 [JP] Japan ..... 6-080493
Feb. 23, 1995 [JP] Japan ..... 7-035439

[51] Int. Cl.[6] ..... F02D 41/14

[52] U.S. Cl. ..... 123/674; 123/686

[58] Field of Search ..... 123/491, 674, 123/675, 685, 686

[56] References Cited

U.S. PATENT DOCUMENTS 5,053,968 10/1991 Uchinami ..... 123/674 X
5,099,817 3/1992 Nakaniwa ..... 123/674

FOREIGN PATENT DOCUMENTS 59-176444 10/1984 Japan .
5-214993 8/1993 Japan .

*Primary Examiner*—Tony M. Argenbright
*Attorney, Agent, or Firm*—Kenyon & Kenyon

[57] ABSTRACT

This fuel injection control apparatus consists of a calculating device for calculating an air-fuel ratio correction factor FAF, a learning device for learning an air-fuel ratio learning factor KG in accordance with the deviation of FAF from the reference value, and a controller for controlling the amount of injected fuel in accordance with FAF and KG. When the start enrichment FASE and the warm-up enrichment FWL are added, KG is learned in accordance with the corrected deviation which is the deviation of FAF corrected by the correction factor f(FASE+FWL) which is concerned with FASE and FWL. The learning accuracy is improved because KG is learned at each region of FWL which is divided into plural regions in accordance with the engine driving conditions.

12 Claims, 10 Drawing Sheets

FUEL-INJECTION CONTROL APPARATUS FOR AN ENGINE

BACKGROUND OF THE INVENTION

1. Field of the Invention

The present invention relates to a fuel-injection control apparatus for an engine, especially to a fuel-injection control apparatus for an engine having an air-fuel ratio learning control system.

2. Description of the Related Arts

An automobile is generally provided with a fuel-injection control apparatus which purges fuel-vapor to the inlet pipe and uses it as fuel in order to avoid air pollution.

In this apparatus, because use of the fuel-vapor disturbs the air-fuel ratio, purging is executed when the air-fuel ratio is controlled by the air-fuel ratio feedback control system.

Furthermore, because it is necessary to avoid an overflow from a charcoal canister which absorbs fuel-vapor evaporating from a fuel tank, it is desirable to dispose of fuel-vapor as much as possible by increasing the frequency, the period and the amount of purging.

In the air-fuel ratio feedback control system, the air-fuel ratio learning control system is generally applied in order to make the deviation of the air-fuel ratio from the stoichiometric air-fuel ratio small by gradually renewing an air-fuel ratio feedback correction factor (FAF). This system compensates for fluctuations in those factors, such as the error and the deterioration with the passage of time of the air-flow meter, the injectors, the pressure regulator and the control unit, the non-linearity of injectors, and changes in the driving condition, which influence the air-fuel ratio.

Both the air-fuel ratio learning control and the purge control are executed while the air-fuel ratio is controlled by the air-fuel ratio feedback control system, but the air-fuel learning factor renewed in the air-fuel learning control system cannot be used for an accurate air-fuel ratio control because it is calculated from the air-fuel ratio feedback correction factor influenced by fuel-vapor.

Therefore, it is difficult to execute these two controls simultaneously. If it is required that they be executed simultaneously, it is necessary that the executing time of the air-fuel ratio learning control be shortened and the purge control be executed as often as possible in order to learn effectively and increase the purge amount.

The air-fuel ratio control system which inhibits the air-fuel ratio feedback control until the engine is warmed-up, that is, until a predetermined time elapses after the engine has started, has been proposed because the burning in the cylinder is not stable due to insufficient atomization and the emission and/or the drivability are deteriorated when the engine is not warmed-up enough (refer to Unexamined Patent Application (Kokai) No. 59-176444).

If the air-fuel ratio learning control is inhibited until a predetermined time elapses after the engine has started, the frequency of the air-fuel ratio learning control is decreased. The start of the purging is delayed and the frequency of purging cannot be secured because the air-fuel ratio learning factor does not converge enough due to the transient operating condition if the air-fuel ratio learning control is begun after a predetermined time elapses.

Furthermore, if it is required that the air-fuel ratio feedback control is executed when the engine is not warmed-up enough, it is common that the air-fuel ratio learning control is inhibited in order to avoid faulty learning because the air-fuel ratio correction factor is influenced by the start enrichment and the warm-up enrichment.

Namely, the air-fuel ratio learning factor is influenced not only by the start enrichment and the warm-up enrichment, but also by the delay time which is inherently required until the air-fuel ratio sensor becomes active. Therefore, the air-fuel ratio learning control cannot substantially be executed when the engine is not warmed-up enough.

Furthermore, because the fuel amount of the warm-up enrichment is not constant and is varied in accordance with the degree of warm-up, the air-fuel ratio learning during warm-up is more difficult to perform.

SUMMARY OF THE INVENTION

It is an object of the present invention to provide a fuel injection control apparatus for an engine which can execute the air-fuel ratio learning control when the start enrichment and the warm-up enrichment is active.

It is also an object of the present invention to provide a fuel injection control apparatus for an engine which can execute the air-fuel ratio learning control while the air-fuel ratio deviation is large.

Furthermore, it is an object of the present invention to provide a fuel injection control apparatus for an engine which can improve the learning accuracy while the start enrichment and the warm-up enrichment are active.

A fuel injection control apparatus for an engine according to the present invention comprises an air-fuel ratio controlling means for calculating an air-fuel ratio correction factor in order to control the air-fuel ratio detected by an air-fuel ratio sensor arranged in an exhaust pipe of an engine for detecting the air-fuel ratio of the exhaust gas at a predetermined target air-fuel ratio; a learning means for learning an air-fuel ratio learning factor in accordance with the deviation of the air-fuel ratio correction factor calculated in said air-fuel ratio control means from the reference value; and a fuel injection valve controlling means for controlling the opening interval of the fuel injection valves based on a basic opening interval in accordance with the driving condition of the engine, the air-fuel ratio correction factor calculated in said air-fuel ratio control means, the air-fuel ratio learning factor learned by said learning means, a start enrichment and a warm-up enrichment; wherein said learning means corrects the deviation of the air-fuel ratio correction factor calculated in said air-fuel ratio control means from the reference value in accordance with the start enrichment and the warm-up enrichment, and learns an air-fuel ratio learning factor in accordance with the corrected deviation when the start enrichment and the warm-up enrichment are added.

According to this fuel-injection control apparatus, the air-fuel ratio learning factor can be learned while the start enrichment and the warm-up enrichment are added, and can be completed early. Furthermore, the air-fuel ratio learning factor can be accurately learned because it is corrected by the correction factor which is concerned with the start enrichment and the warm-up enrichment.

BRIEF DESCRIPTION OF THE DRAWINGS

The present invention will be more clearly understood from the description as set forth below with reference to the accompanying drawings, wherein.

DESCRIPTION OF THE PREFERRED EMBODIMENT

Figure 1:
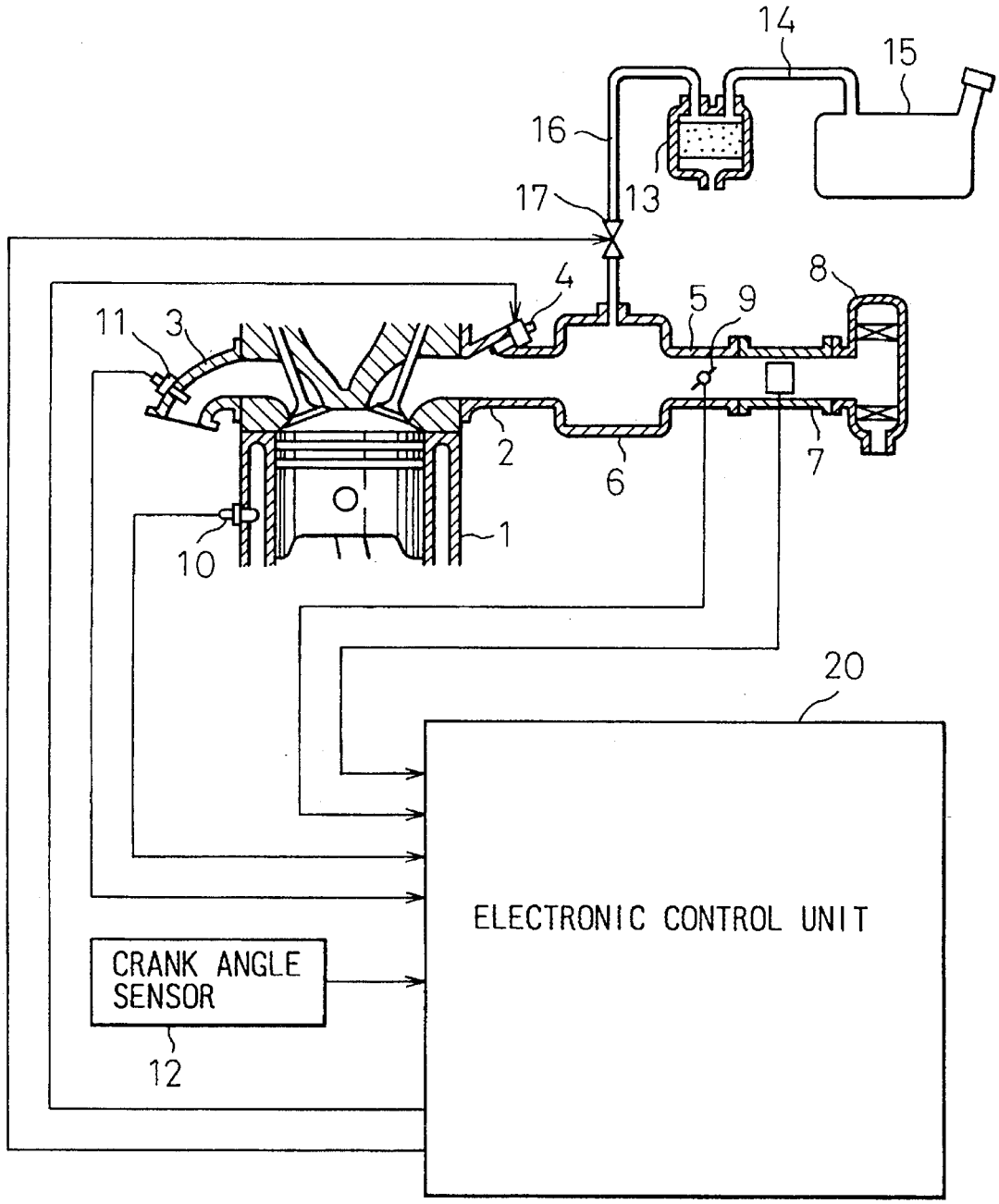
FIG. 1 is a schematic diagram of the fuel-injection control apparatus for the engine according to the present invention.

FIG. 1 is a schematic diagram of the fuel injection control apparatus for an engine showing the main constituent features according to the present invention. In this figure, the reference numeral "1" indicates the engine, "2" indicates the intake manifold, "3" indicates the exhaust manifold, "4" indicates the fuel injection valve, "5" indicates the intake pipe, indicates the surge tank, "7" indicates the air-flow meter, "8" indicates the air cleaner, "9" indicates the throttle valve, "10" indicates the coolant thermometer, "11" indicates the air-fuel ratio sensor, "12" indicates the crank angle sensor, "13" indicates the charcoal canister, "14" indicates the vapor pipe, "15" indicates the fuel tank, "16" indicates the purge pipe, "17" indicates the purge valve, and "20" indicates the electronic control unit.

The electronic control unit 20 judges the driving condition of the engine 1 based on the signals detected by the air-flow meter 7, the coolant thermometer 10 and the crank angle sensor 12 and on the opening of the throttle valve 9, and determines the basic fuel injection amount in accordance with the driving condition. It adjusts the basic fuel injection amount in accordance with the output signal from the air-fuel ratio sensor 11, and executes the air-fuel ratio feedback control by controlling the fuel injection valve 4.

The electronic control unit 20 executes the air-fuel ratio learning control with the air-fuel ratio control in order to adjust the error, and the deterioration, with the passage of time, of the elements of the fuel injection control system.

The fuel-vapor evaporating from the fuel tank 15 is absorbed in the charcoal canister 13 via the vapor pipe 14, and is purged to the inlet pipe 2 via the purge pipe 16 with the purge rate determined by the opening of the purge valve 17, which is controlled by the electronic control unit 20.

Figure 2:
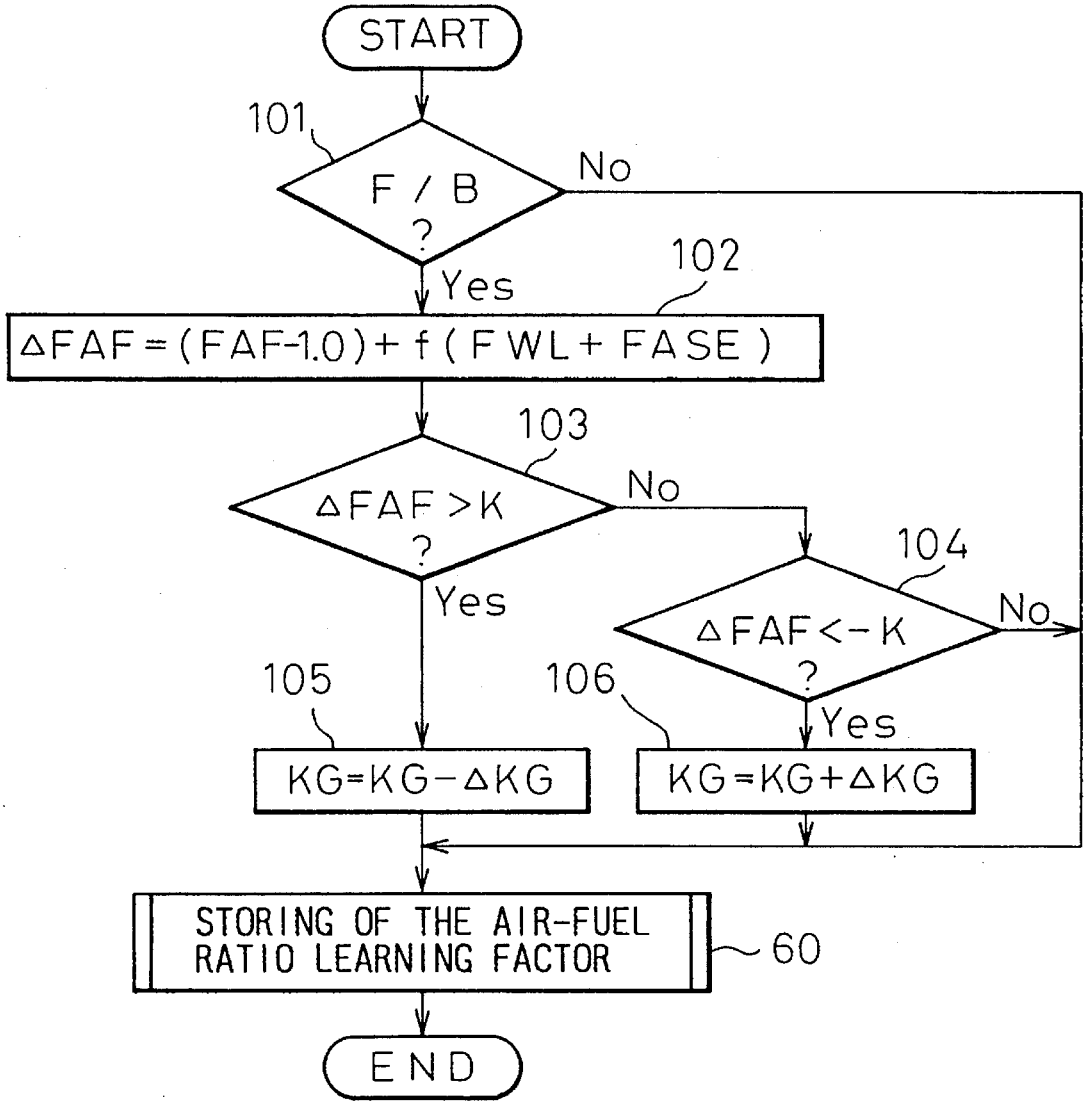
FIG. 2 is a flowchart of the first air-fuel ratio learning routine.

FIG. 2 is a flowchart of the first air-fuel ratio learning control routine executed at every predetermined interval in the electronic control unit 20.

At step 101, it is determined whether or not the air-fuel ratio feedback control is allowable. If the determination at step 101 is negative, the control directly proceeds to step 60. If it is affirmative, the control proceeds to step 102 in order to calculate the deviation of the air-fuel ratio correction factor FAF from the reference value, that is, "1.0" to compensate for the start enrichment and the warm-up enrichment.

Namely, the deviation ΔFAF is calculated at step 102 according to the following equation.

$$\Delta FAF=(FAF-1.0)+f(FWL+FASE)$$

where f(FWL+FASE) is the compensation factor determined from the start enrichment FWL and the warm-up enrichment FASE.

Step 103 and step 104 function as the dead band for the deviation ΔFAF. If the determination at step 103 is affirmative, that is, if ΔFAF>K, the control proceeds to step 105, where the learning factor KG decreases ΔKG.

$$KG=KG-\Delta KG$$

On the other hand, if the determination at step 104 is affirmative, that is, if ΔFAF <−K, the control proceeds to step 106, where the learning factor KG increases ΔKG.

$$KG=KG+\Delta KG$$

This routine is terminated after the air-fuel ratio learning factor storing routine is executed at step 60.

Figure 6:
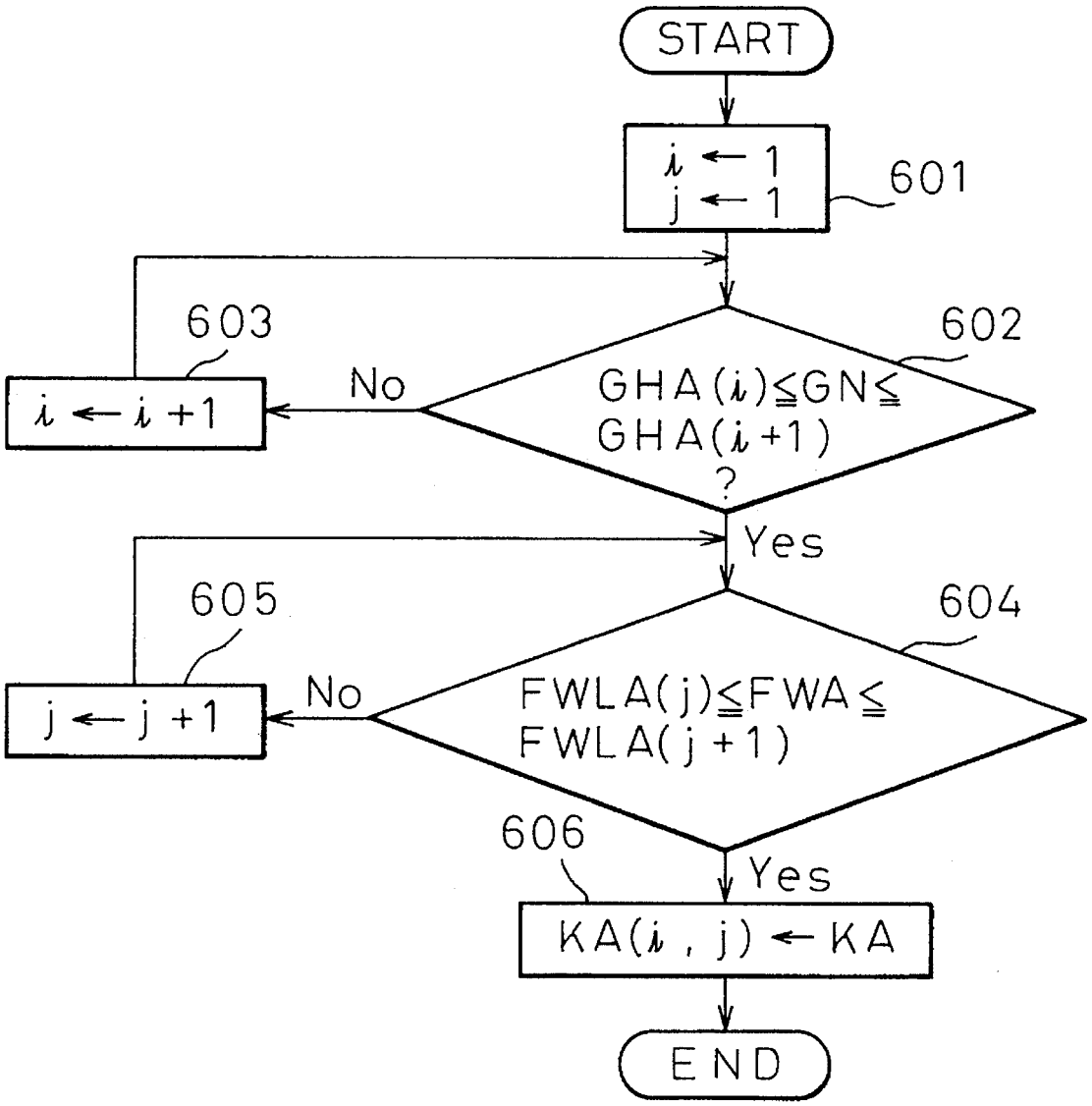
FIG. 6 is a flowchart of the storing routine.

FIG. 6 is the flowchart of the air-fuel ratio learning factor storing routine. At step 601, the index "i", which denotes the region of the array of the inlet air-flow GNA, and the index "j", which denotes the region of the array of the warm-up enrichment FWLA, are reset.

At step 602, it is determined to which region of the array GNA the present inlet air-flow GN belongs, that is, it is determined whether or not the following equation is satisfied.

$$GNA(i)\leqq GN\leqq GNA(i+1)$$

If the determination at step 602 is negative, the control returns to step 602 after the increment of the index "i" at step 603.

If the determination at step 602 is affirmative, the control proceeds to step 604, where it is determined to which region of the array FWLA the present warm-up enrichment FWL belongs, that is, it is determined whether or not the following equation is satisfied.

$$FWLA(i)\leqq FWL\leqq FWLA(i+1)$$

If the determination at step 604 is negative, the control returns to step 604 after the increment of the index "j" at step 605.

If the determination at step 604 is affirmative, the control proceeds to step 606 where the renewed learning factor KG is stored to the learning factor array KA and the address thereof is specified by the index "i" and the index "j".

Namely, $$KA(i, J)=KG$$

Then this routine is terminated.

According to the first embodiment, the air-fuel ratio learning factor is correctly learned, that is, the correct air-fuel ratio learning factor can be learned when the start enrichment and the warm-up enrichment is added, because the air-fuel ratio learning factor is learned by correcting the deviation ΔFAF by the correction factor f(FWL+FASE) which is concerned with the start enrichment and the warm-up enrichment. Therefore, the convergence of the air-fuel ratio learning factor can be accelerated, and enough purging time can be assured.

Figure 5A:
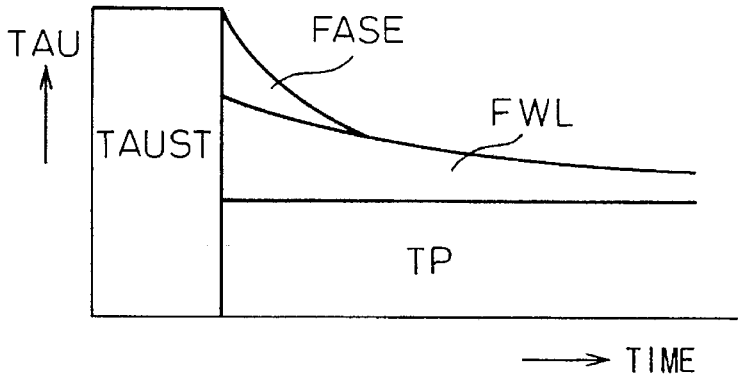
FIG. 5A is a graph showing the start enrichment and the warm up enrichment.

FIG. 5(A) is the graph showing the transient characteristic of the injection fuel TAU, the warm up enrichment FWL, and the enrichment correction factor FASE. Note, TP denotes the basic injection fuel, and TAUST denotes the initial injection fuel. The enrichment correction factor FASE, which is the correction factor for the fuel adhering to the wall, is decreased in accordance with time, and has an initial value determined in accordance with the coolant temperature. The warm-up enrichment FWL is the correction factor determined in accordance with the coolant temperature.

Therefore, because it is possible to specify the region of the array FWLA in accordance with the coolant temperature THW, the air-fuel ratio learning factor KG can be stored using the array of the coolant temperature THWA instead of the array of the warm-up enrichment array FWLA at step 604 in the air-fuel ratio learning factor storing routine.

Figure 3:
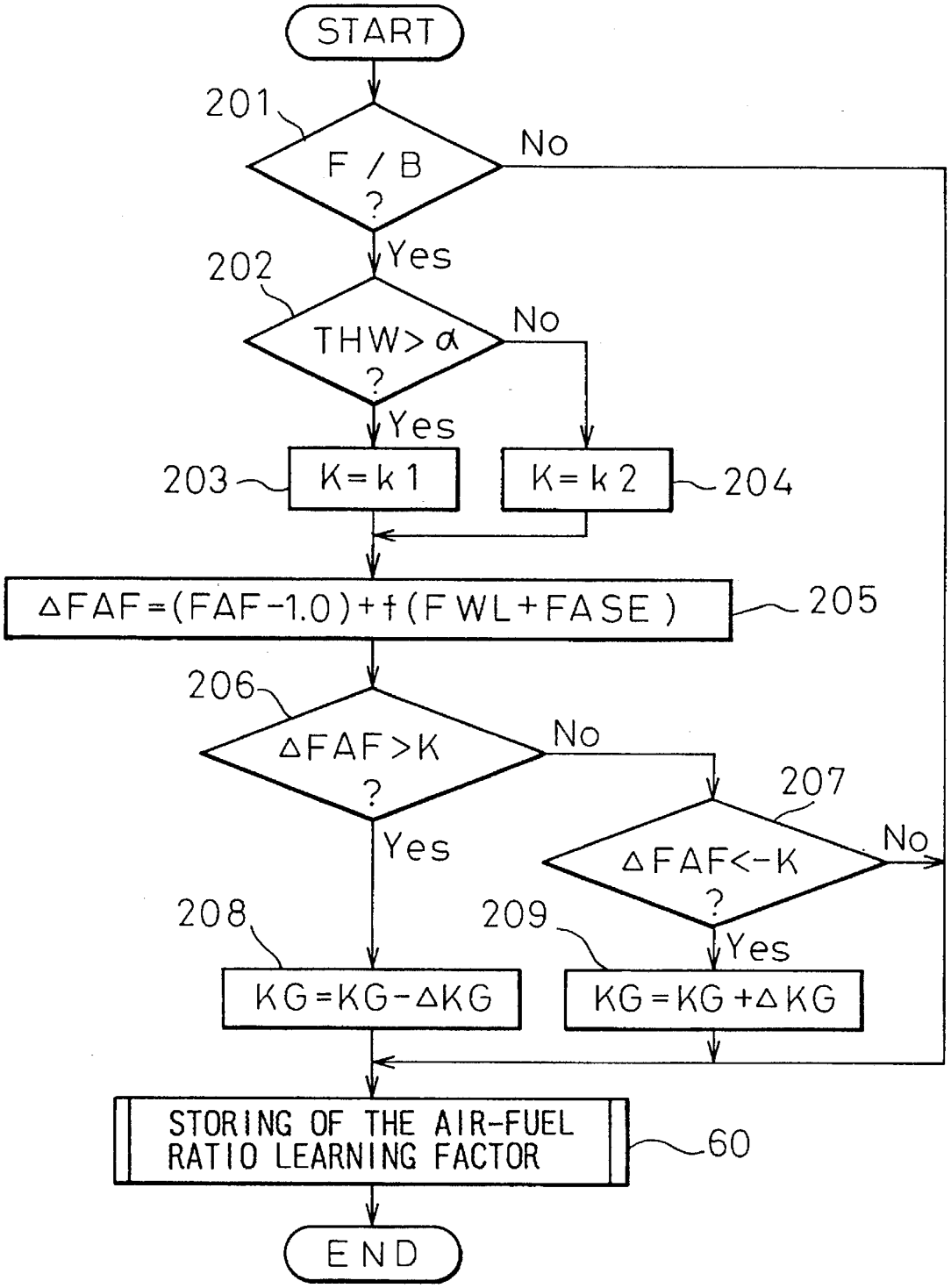
FIG. 3 is a flowchart of the second air-fuel ratio learning routine.

FIG. 3 is a flowchart of the second air-fuel ratio learning control routine executed at every predetermined interval in the electronic control unit 20.

At step 201, it is determined whether or not the air-fuel ratio feedback control is allowable. If the determination at step 201 is negative, the control directly proceeds to step 60. If it is affirmative, the control proceeds to step 202, where it is determined whether or not the coolant temperature THW is higher than the predetermined temperature α.

Namely, the air-fuel ratio learning factor is affected not only by the start enrichment and the warm-up enrichment as described above, but also by the delay time which is inherently required-until the air-fuel ratio sensor becomes active if the air-fuel ratio learning factor is learned when the coolant temperature is low. Because the lower the coolant temperature is, the longer this delay time becomes, the air-fuel ratio correction factor is affected by low coolant temperature. In the second embodiment, an error in the air-fuel ratio learning factor due to this delay time is compensated for by the dead band.

Namely, if the determination at step 202 is affirmative, that is, if the coolant temperature THW is higher than α, the value K is set to k1 which is relatively small. On the other hand, if the determination at step 202 is negative, that is, if the coolant temperature THW is lower than α, the value K is set to k2 which is relatively large.

The control proceeds to step 205 in order to calculate the deviation Of the air-fuel ratio correction factor FAF from the reference value, that is, "1.0" to compensate for the start enrichment and the warm-up enrichment.

Namely, the deviation ΔFAF is calculated according to the following equation.

$$\Delta FAF=(FAF-1.0)+f(FWL+FASE)$$

where f(FWL+FASE) is the compensation factor determined from the start enrichment FWL and the warm-up enrichment FASE.

Step 206 and step 207 function as the dead band for the deviation ΔFAF. If the determination at step 206 is affirmative, that is, if ΔFAF>K, the control proceeds to step 208, where the learning factor KG is decreased by ΔKG.

$$KG=KG-\Delta KG$$

On the other hand, if the determination at step 207 is affirmative, that is, if ΔFAF<−K, the control proceeds to step 209, where the learning factor KG is increased by ΔKG.

$$KG=KG+\Delta KG$$

This routine is terminated after the air-fuel ratio learning factor storing routine, shown in FIG. 6, is executed at step 60.

According to the second embodiment, the correct air-fuel ratio learning factor can be got not only by avoiding the influence of the start enrichment and the warm-up enrichment, but also by changing the width of the dead band in accordance with the coolant temperature. It is effective to increase the width of the dead band when the coolant temperature is low, because the various kinds of enrichment are used when the coolant temperature is low, and the air-fuel ratio learning factor is greatly influenced by these enrichments. Therefore, the convergence of the air-fuel ratio learning factor can be accelerated, and enough purging time can be assured.

Figure 5B:
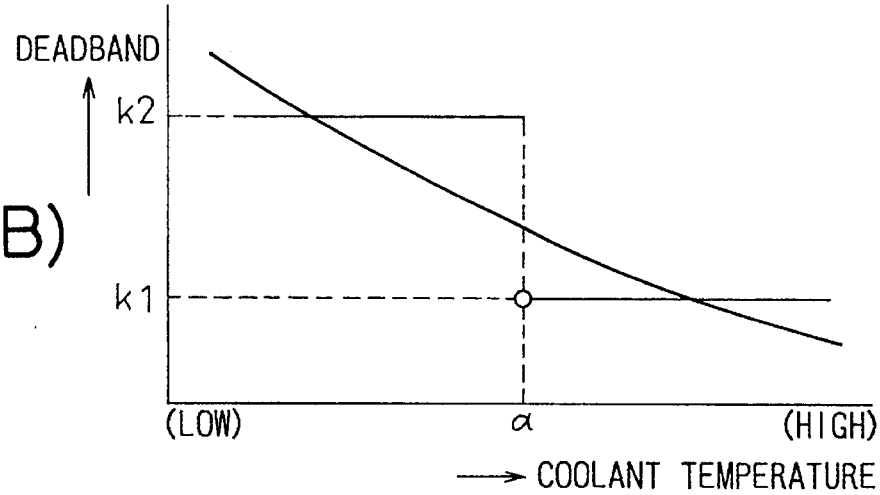
FIG. 5B is a graph showing the dead band characteristic.

Note, FIG. 5(B) shows the graph for determining the width of the dead band in accordance with the coolant temperature, and this curve is decreased in accordance with the coolant temperature. In the second embodiment, the coolant temperature is divided into the low temperature region and the high temperature region, and the two different widths of the dead band k1, k2(k1>k2) are determined for each region.

Figure 4:
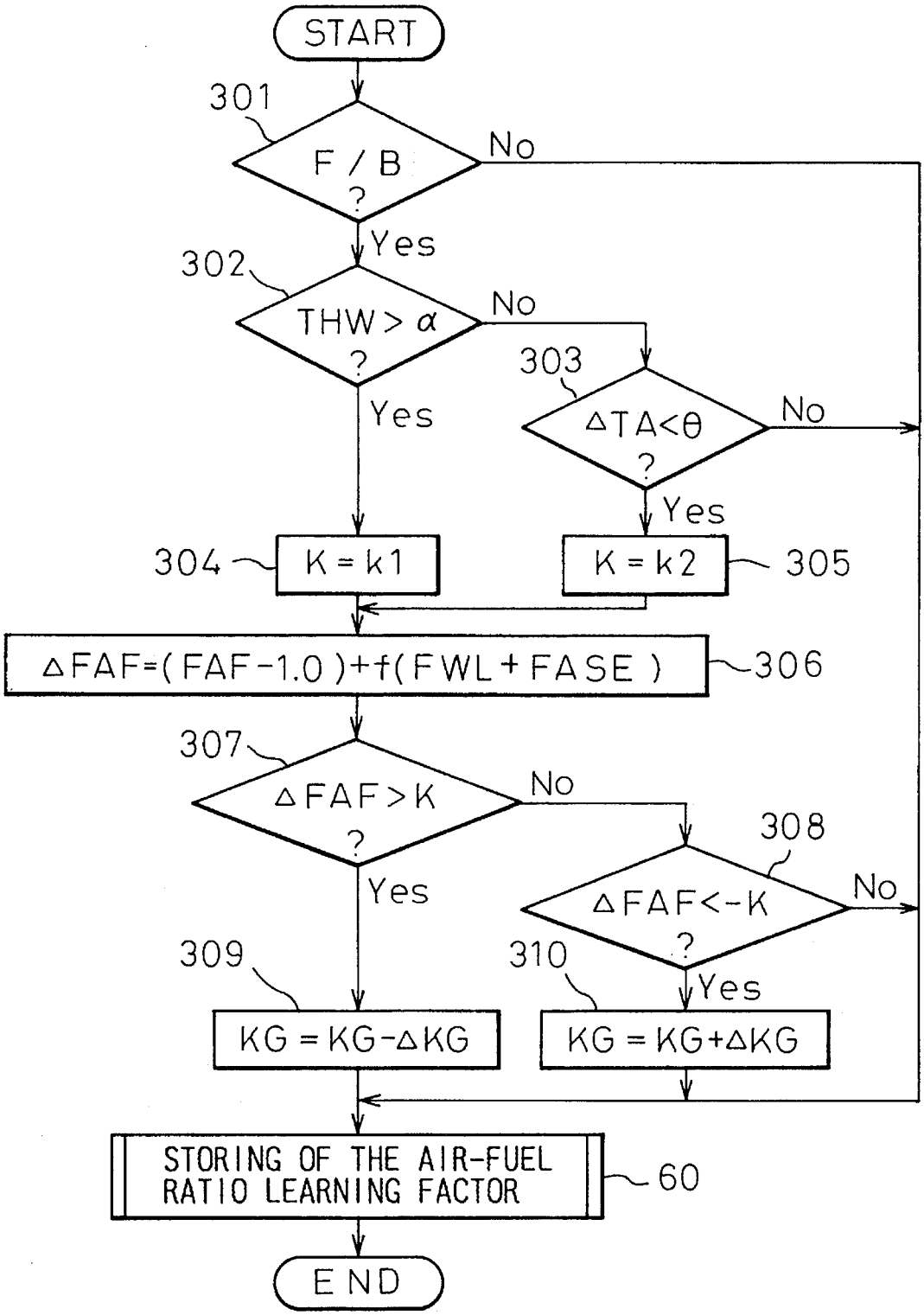
FIG. 4 is a flowchart of the third air-fuel ratio learning routine.

FIG. 4 is a flowchart of the third air-fuel ratio learning control routine executed at every predetermined interval in the electronic control unit 20.

At step 301, it is determined whether or not the air-fuel ratio feedback control is allowable. If the determination at step 301 is negative, the control directly proceeds to step 60. If it is affirmative, the control proceeds to step 302, where it is determined whether or not the coolant temperature THW is higher than the predetermined temperature α.

If the determination at step 302 is affirmative, that is, if the coolant temperature THW is higher than α, the control proceeds to step 304, where the value K is set to k1 which is relatively small. On the other hand, if the determination at step 302 is negative, that is, if the coolant temperature THW is lower than α, the control proceeds to step 303, where it is determined whether or not the throttle valve opening rate ΔTA is larger than the predetermined rate θ.

If the determination at step 303 is negative, the control proceeds directly to step 60 in order not to learn the air-fuel ratio learning factor. If the determination at step 303 is affirmative, the control proceeds to step 305, where the value K is set to k2 which is relatively large.

The control proceeds to step 306 in order to calculate the deviation of the air-fuel ratio correction factor FAF from the reference value, that is, "1.0" to compensate for the start enrichment and the warm-up enrichment.

Namely, the deviation ΔFAF is calculated according to the following equation.

$$\Delta FAF=(FAF-1.0)+f(FWL+FASE)$$

where f(FWL+FASE) is the compensation factor determined from the start enrichment FWL and the warm-up enrichment FASE.

Step 307 and step 308 function as the dead band for the deviation ΔFAF. If the determination at step 307 is affirmative, that is, if ΔFAF>K, the control proceeds to step 309, where the learning factor KG is decreased by ΔKG.

$$KG=KG-\Delta KG$$

On the other hand, if the determination at step 308 is affirmative, that is, if ΔFAF<−K, the control proceeds to step 310, where the learning factor KG is increased by ΔKG.

$$KG=KG+\Delta KG$$

This routine is terminated after the air-fuel ratio learning factor storing routine shown in FIG. 6 is executed at step 60.

According to the third embodiment, the air-fuel ratio learning is inhibited when the coolant temperature THW is smaller than α and the throttle valve opening rate ΔTA is larger than θ, because the air-fuel ratio correction factor FAF is disturbed by the sudden opening change of the throttle valve, and the air-fuel ratio control cannot follow to the correction of the purge amount.

Figure 7:
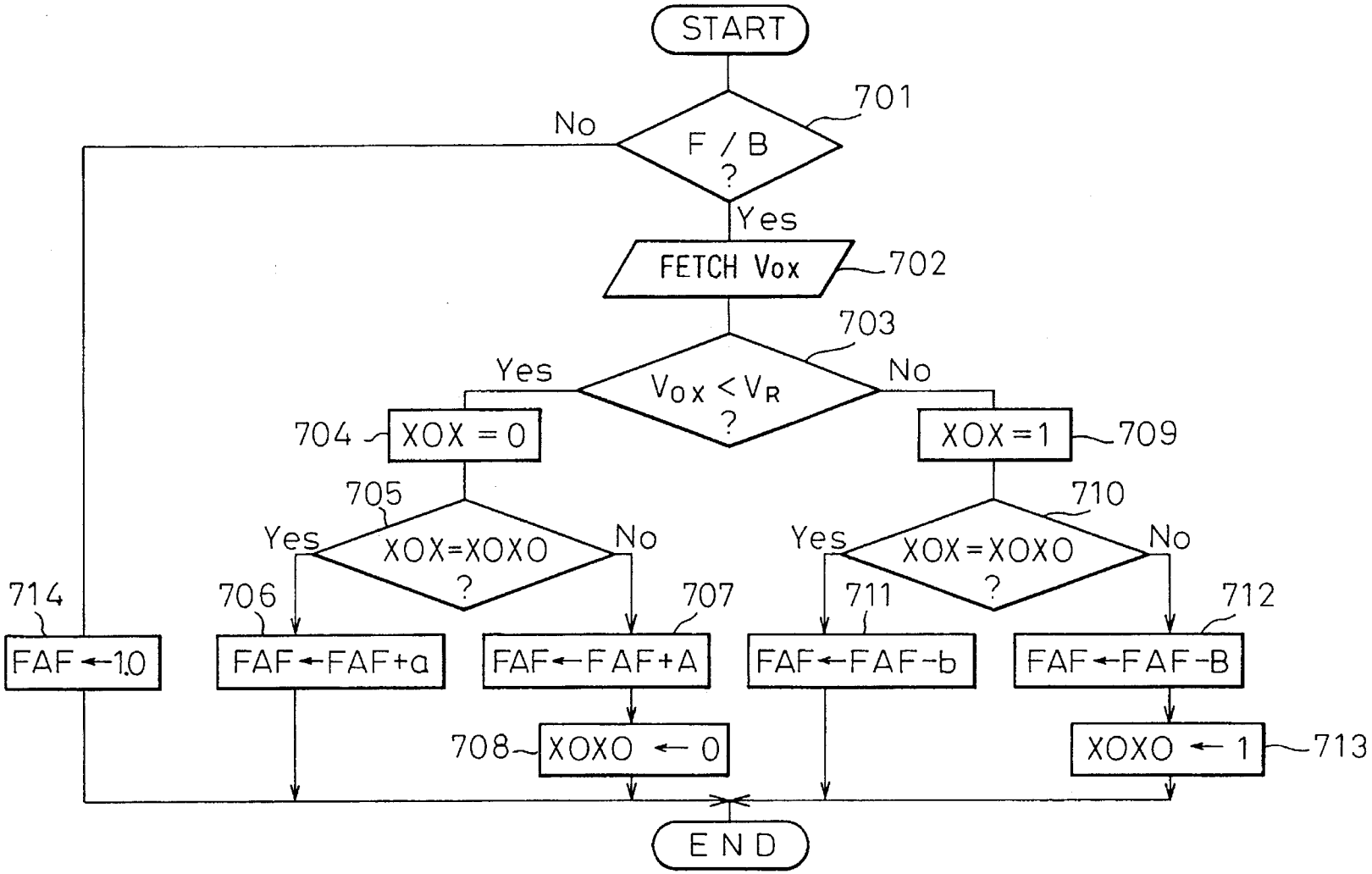
FIG. 7 is a flowchart of the air-fuel ratio control routine.

FIG. 7 is the flowchart of the air-fuel ratio control routine commonly used in all embodiments, and this routine is executed every predetermined cam angle.

At step 701, it is determined whether or not the air-fuel control is allowable. If the determination at step 701 is affirmative, the control proceeds to step 702, where the output voltage $V_{ox}$ of the air-fuel ratio sensor 11 is fetched. At step 703, it is determined whether or not the output voltage $V_{ox}$ is lower than the predetermined reference voltage $V_R$ (for example, 0.45 V).

If the determination at step 703 is affirmative, that is, if the air-fuel ratio of the exhaust gas is lean, the control proceeds to step 704, where the air-fuel ratio flag XOX is set to "0".

At step 705, it is determined whether or not the air-fuel ratio flag XOX is identical with the status keeping flag XOXO.

If the determination at step 705 is affirmative, that is, if the lean state continues, control proceeds to step 706, where the air-fuel ratio correction factor FAF increases the lean integration constant "a", and this routine is terminated.

If the determination at step 705 is negative, that is, if the air-fuel ratio is changing from the rich state to the lean state, the control proceeds to step 707, where the air-fuel ratio correction factor FAF increases the lean skip constant "A".

Note, the lean skip constant "A" is set to a much larger value than the lean integration constant "a".

At step 708, the status keeping flag XOXO is reset, and this routine is terminated.

If the determination at step 703 is negative, that is, if the air-fuel ratio of the exhaust gas is rich, the control proceeds to 709, where the air-fuel ratio flag XOX is set to "1".

At step 710, it is determined whether or not the air-fuel ratio flag XOX is identical to the status keeping flag XOXO.

If the determination at step 710 is affirmative, that is, if the rich state continues, control proceeds to step 711, where the air-fuel ratio correction factor FAF decreases the rich integration constant "b", and this routine is terminated.

If the determination at step 710 is negative, that is, if the air-fuel ratio is changing from the lean state to the rich state, control proceeds to step 712, where the air-fuel ratio correction factor FAF decreases the rich skip constant "B".

Note, the rich skip constant "B" is set to a much larger value than the rich integration constant "b".

At step 713, the status keeping flag XOXO is set to "1", and this routine is terminated.

Note, when the determination at step 701 is negative, the control proceeds to step 714, where the air-fuel ratio correction factor FAF is set to "1.0", and this routine is terminated.

Figure 8:
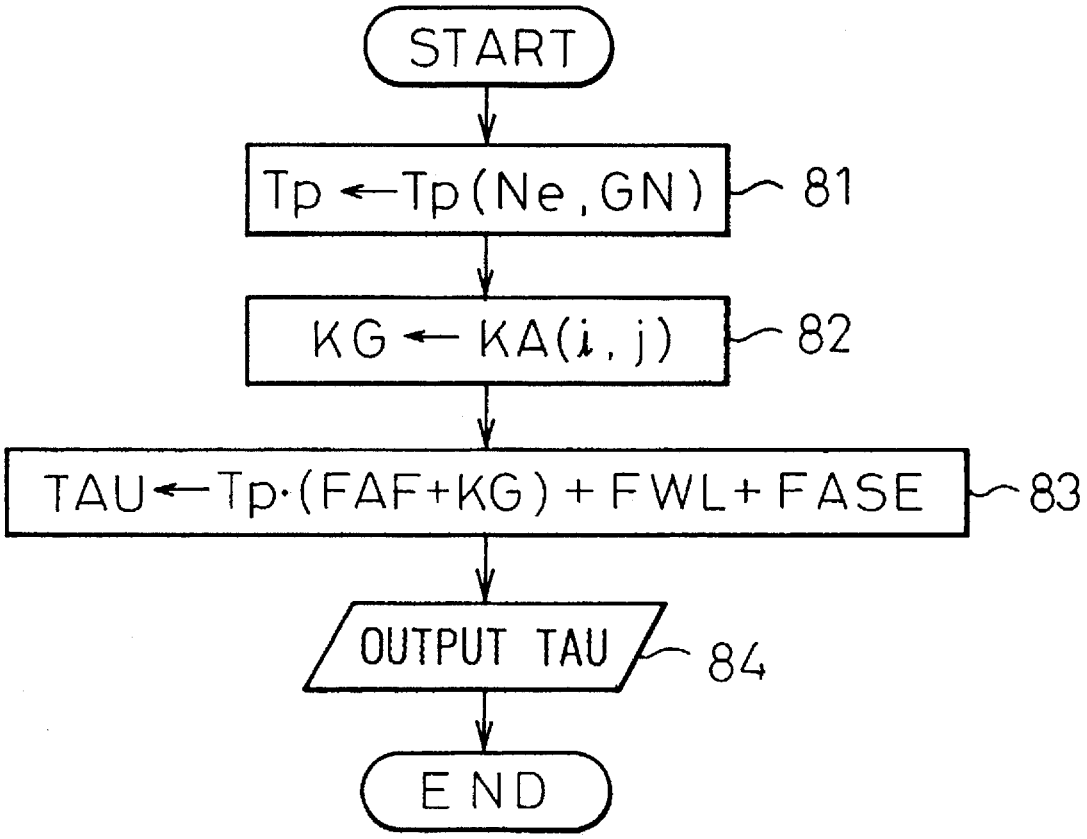
FIG. 8 is a flowchart of the fuel injecting routine.

FIG. 8 is the flowchart of the fuel injection valve control routine commonly used in all embodiments, and this routine is executed every predetermined cam angle.

At step 81, the basic fuel injection valve opening interval is calculated as the function of the engine speed Ne and the inlet air-flow rate GN.

$$Tp=Tp\ (Ne,\ GN)$$

At step 82, the air-fuel ratio learning factor which is specified by the index "i" and the index "j" is recalled from the air-fuel ratio learning factor array KA determined in the air-fuel ratio learning routine. Namely, the air-fuel ratio learning factor KG is determined from the following equation.

$$KG=KA\ (i,\ j)$$

At step 83, the fuel injection valve opening interval TAU is calculated from the air-fuel ratio learning factor KG, the air-fuel ratio correction factor FAF determined in the air-fuel ratio control routine, the warm-up enrichment FWL and the start enrichment FASE.

$$TAU=Tp\cdot FAF\cdot KG+FWL+FASE$$

This routine is terminated after the opening interval of the fuel injection valve 4 is controlled in accordance with the fuel injection valve opening interval TAU at step 84.

If the air-fuel ratio control system having one air-fuel ratio sensor 11 arranged to the exhaust manifold is used, the exhaust gas emission may be disturbed because the air-fuel ratio sensor 11 is disturbed by the difference between the emission exhausted from each cylinder.

To solve the above-mentioned problem, a known two sensor system can be applied to the inventions according to claims 1 to 4.

Namely, it is also possible to determine the auxiliary air-fuel ratio learning factor in accordance with warm-up enrichment in order to initiate the auxiliary air-fuel ratio control using the auxiliary air-fuel ratio sensor as soon as possible and as exactly as possible.

Figure 9:
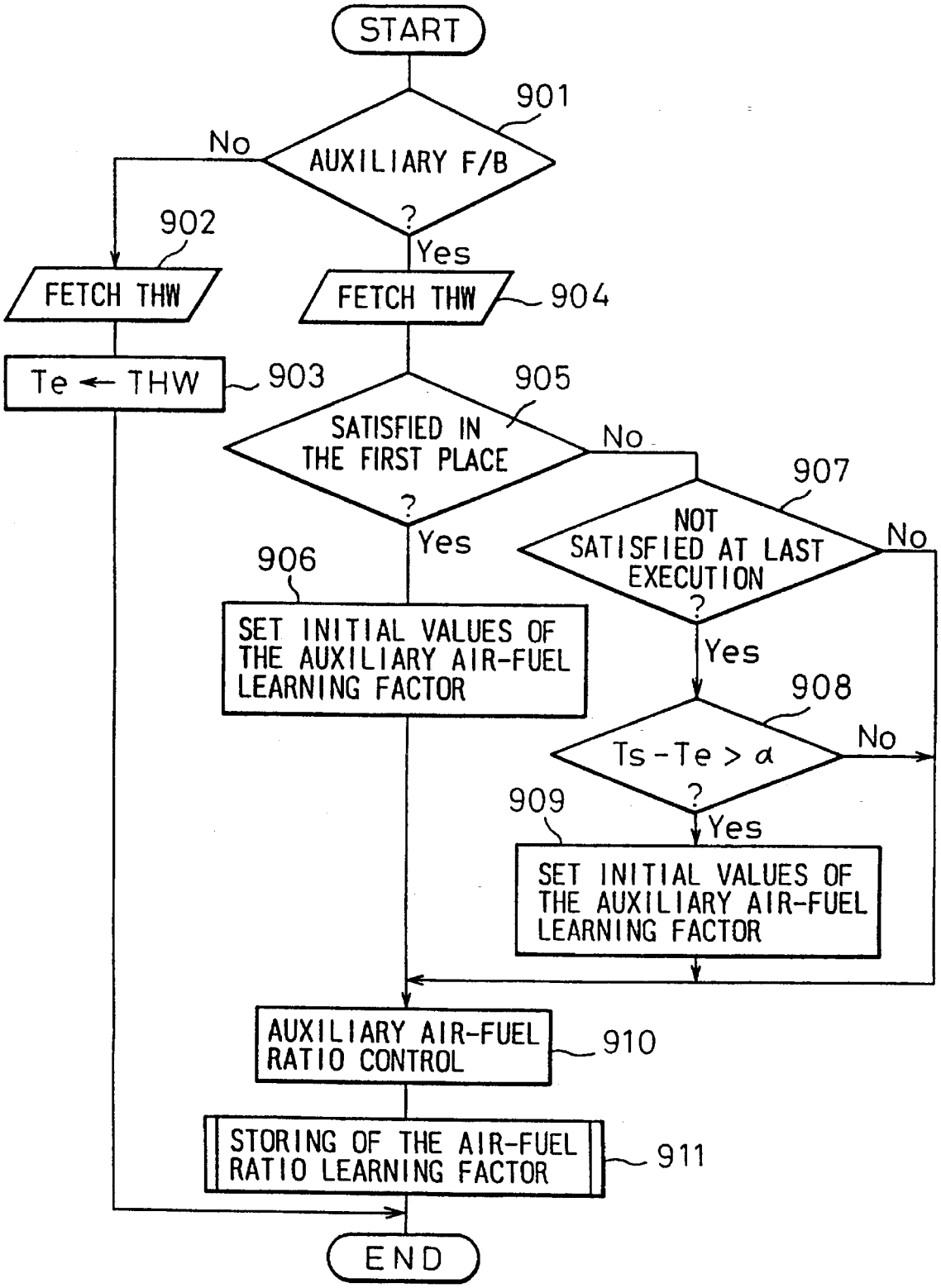
FIG. 9 is a flowchart of the air-fuel ratio sub-control routine.

FIG. 9 is the flowchart of the auxiliary air-fuel ratio control routine. At step 901, it is determined whether or not the auxiliary air-fuel ratio control is allowable.

Namely, (1) The main air-fuel ratio feedback control is allowable.

(2) The auxiliary air-fuel ratio sensor has been activated.

(3) The engine is not idle.

If any one of the above-mentioned conditions is not satisfied, that is, if the determination at step 901 is negative, the control proceeds to step 902, where the coolant temperature THW is fetched. This routine is terminated after the temperature is stored as Te, which denotes the coolant temperature when the auxiliary air-fuel ratio control is not allowable at step 903.

If all the above-mentioned items are satisfied, that is, if the determination at 901 is affirmative, the control proceeds to step 904 where the coolant temperature is fetched and stored as Ts, which denotes the coolant temperature when the auxiliary air-fuel ratio control is allowable.

At step 905, it is determined whether or not all auxiliary air-fuel ratio control conditions are satisfied in the first place. If the determination at step 905 is affirmative, the control proceeds to step 906, where the initial value of the auxiliary air-fuel ratio learning factor is set, and the control proceeds to step 910.

If the determination at step 905 is negative, the control proceeds to step 907, where it is determined whether or not all auxiliary air-fuel ratio control conditions have been satisfied at the last execution. If the determination at 907 is negative, that is, if these have been satisfied at the last execution, the control proceeds directly to step 910.

If the determination at step 907 is affirmative, that is, if all auxiliary air-fuel ratio control conditions were not satisfied at the last execution, the control proceeds to step 908, where it is determined whether or not the difference (Ts−Te) is larger than the predetermined value β.

If the determination at step 908 is negative, the control proceeds directly to step 910. Otherwise, the control proceeds to step 909, where the initial value of the auxiliary air-fuel ratio learning factor is again set, and the proceeds to step 910.

At step 910, the auxiliary air-fuel ratio control is executed in order to calculate the auxiliary air-fuel ratio correction factor $FAF_2$.

For the auxiliary air-fuel ratio control, the skip control or the integral control used in the air-fuel ratio control of FIG. 7 can be applied.

Note, the control coefficients (for example, skip constant, etc.) which are used in the main air-fuel ratio control, may be changed instead of the auxiliary air-fuel ratio correction factor $FAF_2$ at steps 706, 707, 712 and 714.

This routine is terminated after the auxiliary air-fuel ratio learning factor $KG_2$ is learned and stored at step 911.

Figure 10:
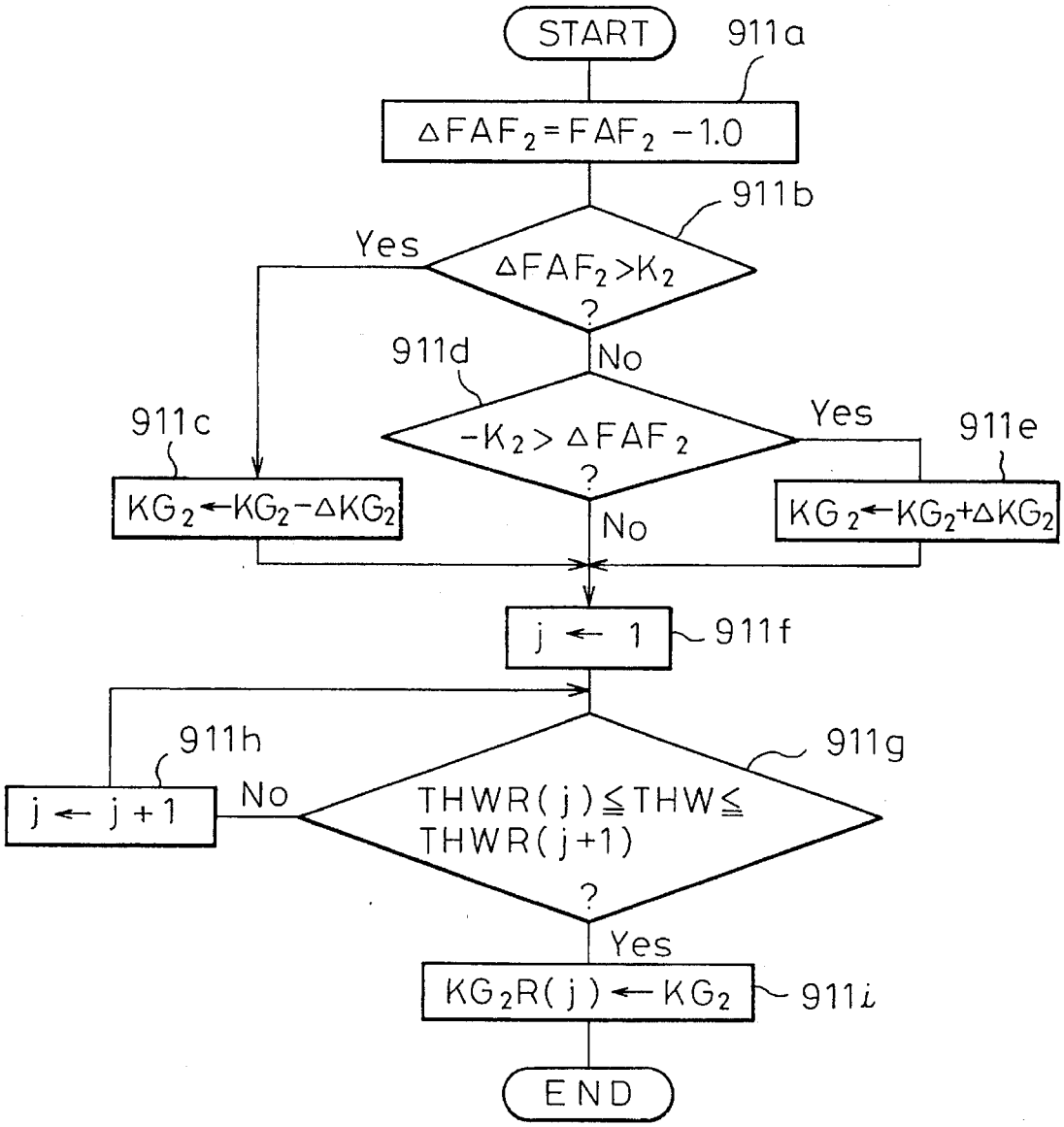
FIG. 10 is a flowchart of the auxiliary storing routine.

FIG. 10 is the flowchart of the auxiliary air-fuel ratio learning factor learning/storing routine, and the auxiliary air-fuel ratio deviation $\Delta FAF_2$ is calculated from the following equation at step 911*a*.

$$\Delta FAF_2 = FAF_2 - 1.0$$

At step 911*b*, it is determined whether or not the auxiliary air-fuel ratio deviation $\Delta FAF_2$ is larger than the second K value $K_2$. If the determination is affirmative, the control proceeds to step 911*c*, where the auxiliary air-fuel ratio learning factor $KG_2$ is renewed from the following equation, and control proceeds to step 911*f*.

$$KG_2 = KG_2 - \Delta KG_2$$

If the determination at step 911*b* is negative, control proceeds to step 911*d*, where it is determined whether or not the auxiliary air-fuel ratio deviation $\Delta FAF_2$ is smaller than $-K_2$.

If the determination at step 911*d* is affirmative, the control proceeds to step 911*e*, where the auxiliary air-fuel ratio learning factor $KG_1$ is renewed from the following equation, and the control proceeds to step 911*f*.

$$KG_2 = KG_2 + \Delta KG_2$$

Note, if the determination at step 911*d* is negative, the control proceeds directly to step 911*f* without renewing the auxiliary air-fuel ratio learning factor $KG_2$.

At step 911*f*, the index "j", which denotes the region of the coolant temperature, is set to "1", and it is determined to which region the present coolant temperature THW belongs from the following equation.

$$THWR(j) \leqq THW \leqq THWR(j+1)$$

If the determination at step 911*g* is negative, the control proceeds to step 911*h*, where the index "j" is incremented, and returns to step 911*h*.

If the determination at step 911*g* is affirmative, the control proceeds to step 911*i*, where the auxiliary air-fuel ratio learning factor $KG_2$ is stored as the "j"th value of the auxiliary air-fuel ratio learning factor array $KG_2R$.

Note, the auxiliary air-fuel ratio correction factor $FAF_2$ and the auxiliary air-fuel ratio learning factor $KG_2$ are used to determine the fuel injection valve opening interval TAU with the air-fuel ratio correction factor FAF and the air-fuel ratio learning factor KG in the fuel injection valve control routine shown at FIG. 8.

According to the fuel injection control apparatus for an engine as set forth in claims 1 and 2, the air-fuel ratio learning can be initiated when the engine is cool or is warming up, and can be early completed. Therefore, the purge can be initiated to increase the purge amount.

According to the fuel injection control apparatus for an engine as set forth in claims 3 and 4, the learning accuracy of the air-fuel ratio learning factor can be improved by determining the air-fuel ratio learning factor in accordance with the warm-up enrichment. Therefore, the deterioration of the exhaust gas emission can be suppressed.

We claim:

1. A fuel injection control apparatus for an engine comprising:

an air-fuel ratio controlling means for calculating an air-fuel ratio correction factor in order to control the air-fuel ratio, detected by an air-fuel ratio sensor arranged in an exhaust pipe of an engine for detecting the air-fuel ratio of the exhaust gas, at a predetermined target air-fuel ratio;

a learning means for learning an air-fuel ratio learning factor in accordance with the deviation of the air-fuel ratio correction factor calculated in said air-fuel ratio control means from the reference value; and a fuel injection valve controlling means for controlling the opening interval of the fuel injection valves based on a basic opening interval in accordance with the driving condition of the engine, the air-fuel ratio correction factor calculated in said air-fuel ratio control means, the air-fuel ratio learning factor learned in said learning means, a start enrichment and a warm-up enrichment; wherein said learning means corrects the deviation of the air-fuel ratio correction factor calculated in said air-fuel ratio control means from the reference value in accordance with the start enrichment and the warm-up enrichment, and learns an air-fuel ratio learning factor in accordance with the corrected deviation while the start enrichment and the warm-up enrichment are added.

2. A fuel injection control apparatus for an engine according to claim 1, wherein said air-fuel ratio control means includes the learning factor renewing means for renewing the air-fuel ratio learning factor when the deviation is above a predetermined range; and said air-fuel ratio control means expands the predetermined range while the start enrichment and the warm-up enrichment are added.

3. A fuel injection control apparatus for an engine according to claim 1, wherein said air-fuel ratio control means learns plural air-fuel ratio learning factors, every one thereof being determined corresponding to every region determined in accordance with the warm-up enrichment.

4. A fuel injection control apparatus for an engine according to claim 3, wherein the warm-up enrichment is determined in accordance with the coolant temperature.

5. A fuel injection control method for an engine comprising the steps of:

calculating an air-fuel ratio correction factor in order to control the air-fuel ratio detected by an air-fuel ratio sensor, arranged in an exhaust pipe of an engine for detecting the air-fuel ratio of the exhaust gas, at a predetermined target air-fuel ratio;

learning an air-fuel ratio learning factor in accordance with the deviation of the air-fuel ratio correction factor calculated at said air-fuel ratio control step from the reference value; and controlling the opening interval of the fuel injection valves based on a basic opening interval in accordance with the driving condition of the engine, the air-fuel ratio correction factor calculated in said air-fuel ratio control step, the air-fuel ratio learning factor learned at said learning step, a start enrichment and a warm-up enrichment; wherein said learning step corrects the deviation of the air-fuel ratio correction factor calculated at said air-fuel ratio control steps from the reference value in accordance with the start enrichment and the warm-up enrichment, and learns an air-fuel ratio learning factor in accordance the corrected deviation while the start enrichment and the warm-up enrichment are added.

6. A fuel injection control method for an engine according to claim 5, wherein said air-fuel ratio control step includes the learning factor renewing step for renewing the air-fuel ratio learning factor when the deviation is above a predetermined range; and said air-fuel ratio control step expands the predetermined range when the start enrichment and the warm-up enrichment are added.

7. A fuel injection control method for an engine according to claim 5, wherein said air-fuel ratio control step learns plural air-fuel ratio learning factors, every one thereof corresponding to every region determined in accordance with the warm-up enrichment.

8. A fuel injection control method for an engine according to claim 7, wherein the warm-up enrichment is determined in accordance with the coolant temperature.

9. A fuel injection control apparatus for an engine according to claim 2, wherein said air-fuel ratio control means learns plural air-fuel ratio learning factors, every one thereof being determined corresponding to every region determined in accordance with the warm-up enrichment.

10. A fuel injection control apparatus for an engine according to claim 9, wherein the warm-up enrichment is determined in accordance with the coolant temperature.

11. A fuel injection control method for an engine according to claim 6, wherein said air-fuel ratio control step learns plural air-fuel ratio learning factors, every one thereof corresponding to every region determined in accordance with the warm-up enrichment.

12. A fuel injection control method for an engine according to claim 11, wherein the warm-up enrichment is determined, in accordance with the coolant temperature.

* * * * *

UNITED STATES PATENT AND TRADEMARK OFFICE

CERTIFICATE OF CORRECTION

PATENT NO. : 5,577,486

DATED : November 26, 1996

INVENTOR(S) : Kenji HARIMA, et al.

It is certified that error appears in the above-indentified patent and that said Letters Patent is hereby corrected as shown below:

Column 8, line 63, change "the" to --then--.

Column 12, line 22, delete the comma after "determined".

Signed and Sealed this

Fifteenth Day of July, 1997

Bruce Lehman

*Attest:*

BRUCE LEHMAN

*Attesting Officer*

*Commissioner of Patents and Trademarks*